US005114291A

United States Patent [19]

Hefty

[11] Patent Number: 5,114,291

[45] Date of Patent: May 19, 1992

[54] METHOD OF MAKING PERSONALIZED CHILDREN'S STORYBOOK

[75] Inventor: John B. Hefty, Milton, Fla.

[73] Assignee: Karen McCraw Hefty

[21] Appl. No.: 571,221

[22] Filed: Aug. 22, 1990

Related U.S. Application Data

[63] Continuation-in-part of Ser. No. 286,083, Dec. 19, 1988, abandoned.

[51] Int. Cl.[5] ..... B42C 9/00; B42D 1/00

[52] U.S. Cl. ..... 412/8; 412/6; 281/15.1; 283/63.1; 283/67

[58] Field of Search ..... 281/15.1; 283/63.1, 283/67; 270/12, 52, 53, 54; 412/6, 7, 8

[56] References Cited

U.S. PATENT DOCUMENTS 3,892,427 7/1975 Kraynak et al. ..... 283/63.1 X
3,982,744 9/1976 Kraynak et al. ..... 283/63.1 X
4,143,889 3/1979 Scharlin ..... 283/63.1 X
4,487,590 12/1984 Becker et al. ..... 283/63.1 X

FOREIGN PATENT DOCUMENTS 8101384 3/1981 Netherlands .

*Primary Examiner*—Joseph M. Gorski
*Assistant Examiner*—Peter Dungba Vo
*Attorney, Agent, or Firm*—Beveridge, DeGrandi & Weilacher

[57] ABSTRACT

The invention pertains to a method of making a book. More particularly, the invention pertains to a method of making a personalized children's storybook using a computer to form text pages having pre-stored, non-variable text merged with personalized, variable text to create an individualized story line. The method of the invention utilizes a personal computer and a laser printer to make text pages for a personalized children's storybook. The text pages include non-variable text and variable text. The non-variable text comprises general information which does not change or vary from book to book of the same title. The variable text comprises specific information which changes or varies for each book depending on the recipient of the book.

8 Claims, 4 Drawing Sheets

VARIABLE TEXT = BOLD TYPE
NON- VARIABLE TEXT = PLAIN TYPE

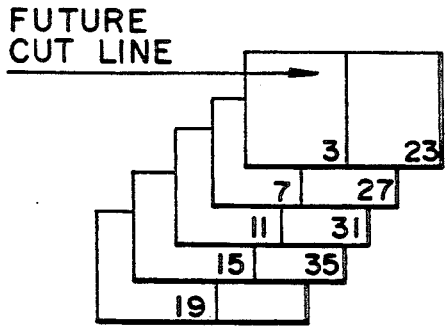
FIG. 3
FIG. 4
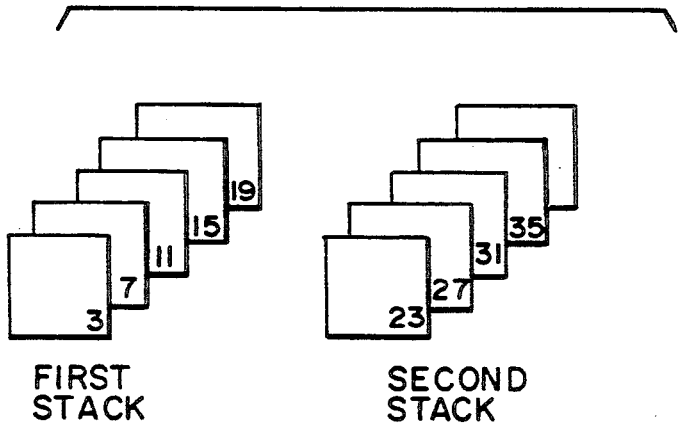
FIG. 5
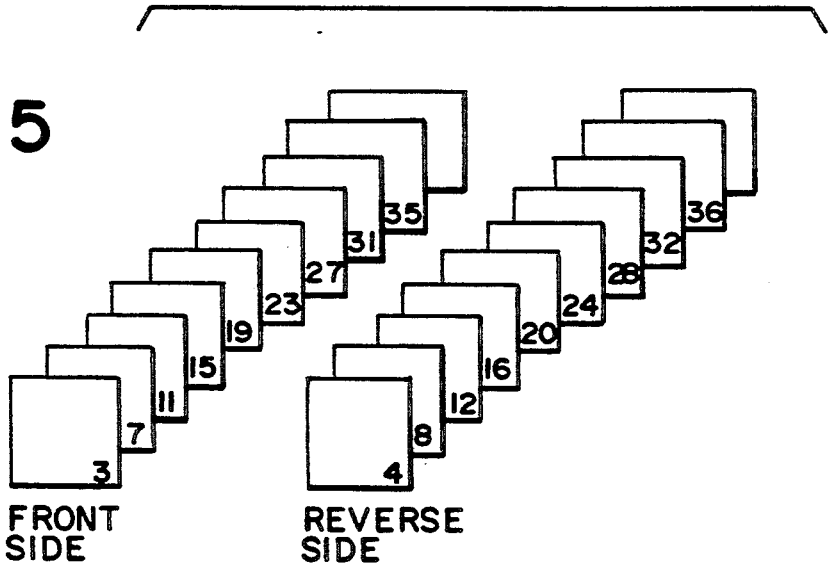

VARIABLE TEXT = BOLD TYPE
NON-VARIABLE TEXT = PLAIN TYPE

METHOD OF MAKING PERSONALIZED CHILDREN'S STORYBOOK

This is a continuation-in-part application of copending U.S. patent application Ser. No. 07/286,083 filed Dec. 19, 1988, now abandoned which is incorporated by reference.

FIELD OF THE INVENTION

The invention pertains to a method of making a book. More particularly, the invention pertains to a method of making a personalized children's storybook using a computer to form text pages having pre-stored, non-variable text merged with personalized, variable text to create an individualized story line.

SUMMARY OF THE INVENTION

The method of the invention utilizes a personal computer and a laser printer to make text pages for a personalized children's storybook. The text pages include non-variable text and variable text. The non-variable text comprises general information which does not change or vary from book to book of the same title. The variable text comprises specific information which changes or varies for each book depending on the recipient of the book.

The method of making the book includes pre-programming and storing non-variable text data in the computer and entering (i.e., keying in) the variable or personal data into the computer. The personalized data is stored in the computer (e.g., such as in a memory string of the computer program, which is well known). Each time a memory string appears in the program, the personalized data is inserted in the text. Paragraphs of the text expand and contract to accommodate the personalized, variable data.

Once the variable data is inserted and has merged with the non-variable data, the computer sends the entire completed story to a laser printer. The printer prints the first half of the book on non-standard, custom-cut eight-inch by thirteen-inch blank pages inserted in the paper tray by the computer operator. The pages are printed in the following sequence: 3, 23, 7, 27, 11, 31, 15, 35, 19.

Once these pages have been printed, the computer operator re-inserts them in the printer paper tray with the printed side face down. The printer then prints the second half of the book on the custom-cut paper in the following sequence: 20, 16, 36, 12, 32, 8, 28, 4, 24.

The pages are cut in half and stacked for proper collation with pre-printed picture pages. After the text pages are collated with the picture pages, self-adhesive sheets are placed on the front and back sides of the stack of printed and collated pages for binding purposes. The pages are bound together in a hard cover to form the personalized children's storybook. An optional, pre-printed paper dust cover may be added.

BRIEF DESCRIPTION OF THE DRAWINGS

FIG. 3 illustrates a stack of 8"×13" pages prior to cutting.

FIG. 4 illustrates the pages after cutting in half so that each page measures 8"×6½".

FIG. 5 shows the cut pages stacked so that smaller numbered pages (starting with page 3) are placed on top of larger numbered pages.

DETAILED DESCRIPTION OF THE INVENTION

A personalized children's storybook includes text pages 10 having non-variable text 11 and variable text 12. The non-variable text 11 comprises general information which does not change or vary from book to book of the same title. The variable text 12 comprises specific information that changes or varies for each book depending on the recipient of the book.

Figure 1:
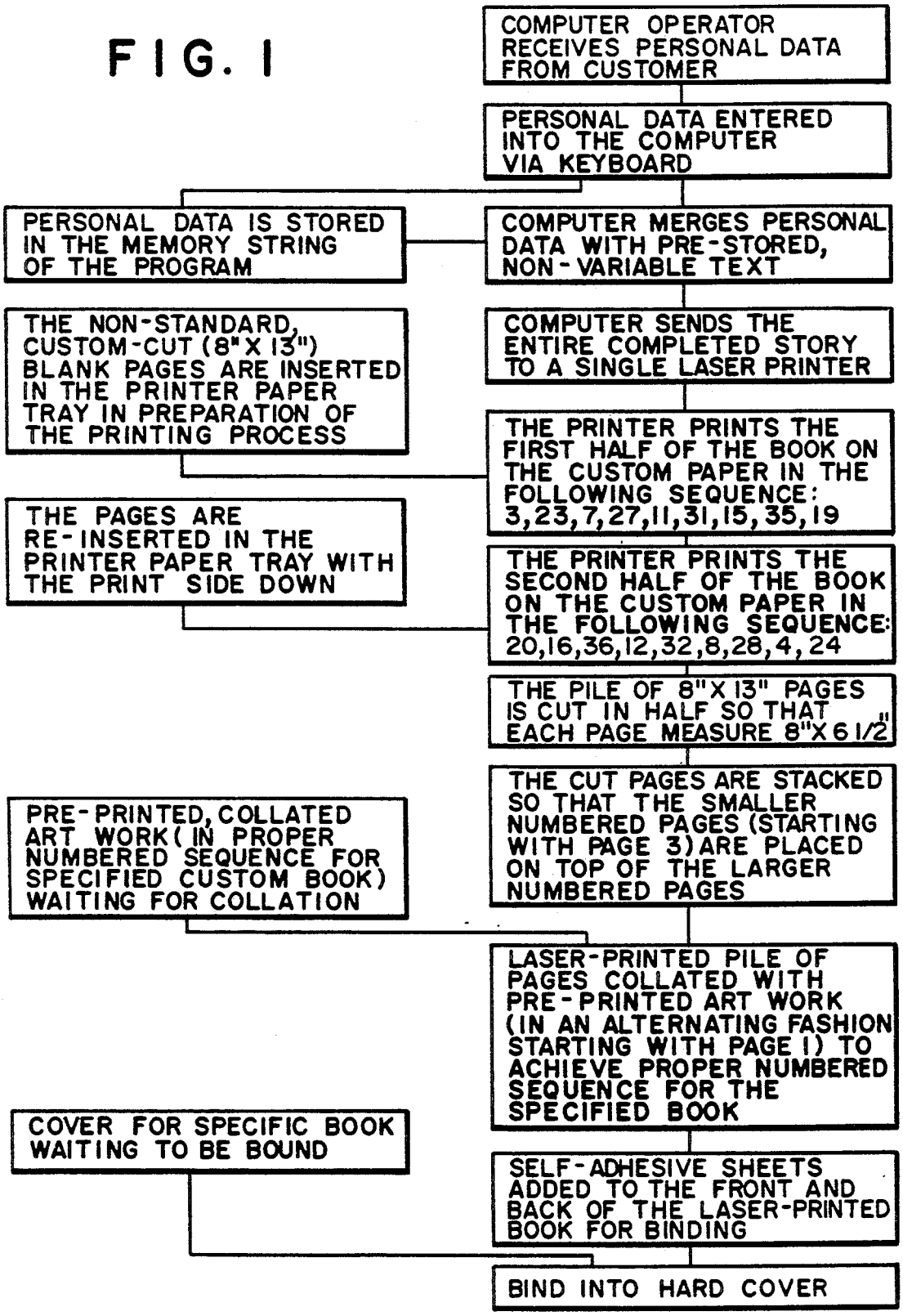
FIG. 1 illustrates the process of creating a personalized children's storybook in accordance with one embodiment of the present invention.
Figure 2:
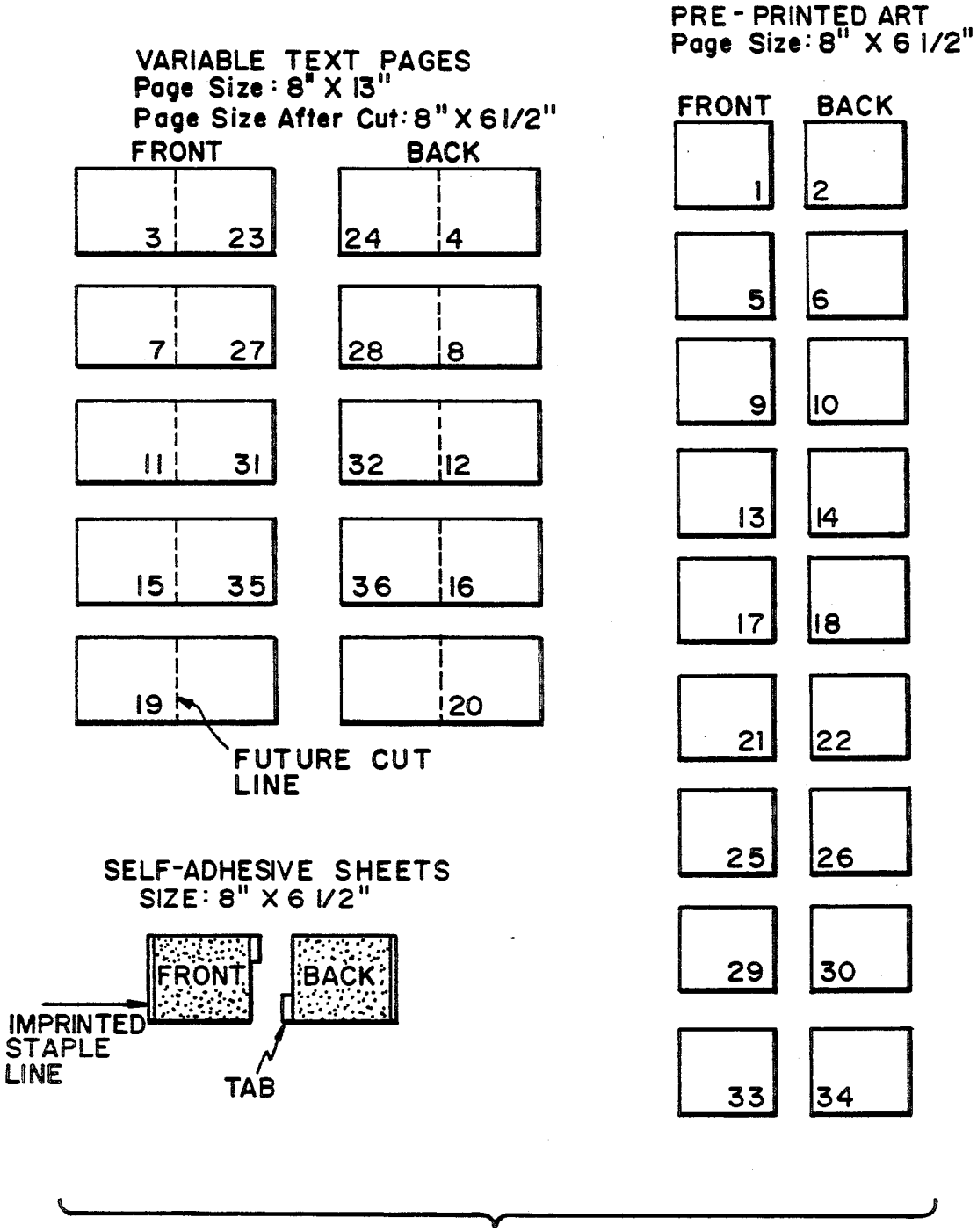
FIG. 2 shows the page layout of the personalized children's storybook.
Figure 6:
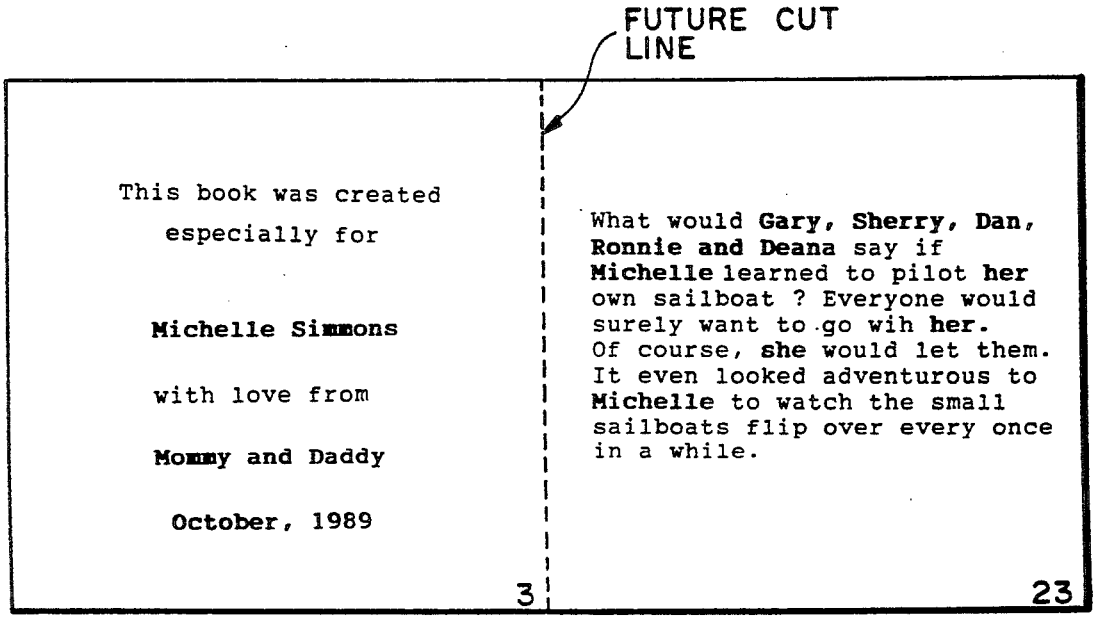
FIG. 6 shows variable and non-variable portions of text on the front side of an 8"×13" page.

The text pages 10 are made utilizing a conventional personal computer and a conventional laser printer. Non-variable text data is pre-programmed and stored in the computer in a predetermined page format. Referring to FIG. 6, the non-variable text 11 includes general, non-personal information that is common to every book of the same title. Typically, the non-variable text 11 includes a children's story having a theme to which most children can generally relate.

Variable text data is entered in the computer when a book is to be made. The variable text 12 includes specific, personal information about a child who is the recipient the book. Typically, the variable text 12 includes the name, address, and age of the child, names of friends and/or relatives of the child, as well as other information of a personal nature about the child.

The variable text is stored in a memory of the computer. Each time a blank space appears in the pre-entered non-variable text data, the computer inserts the appropriate variable text data in the blank space. The computer inserts the appropriate variable text data in the blank spaces provided throughout the non-variable text data to thereby form a storybook format which includes non-variable and variable text data. As shown in FIG. 6, the non-variable data expands and contracts to accommodate the variable data. Once the variable and non-variable data are merged in the computer, they form a completed and personalized storybook format.

The variable text can be stored in memory strings in the program. Each time a memory string appears in the program, the variable text is inserted. Paragraphs expand and contract to accommodate the variable data. Once the variable and non-variable data are merged in the program, they form a complete story line for the specific, individual book.

The computer can be programmed to print the completed, personalized storybook format in a predetermined page order, e.g., to first print odd-numbered text pages and to then print even-numbered text pages.

Blank sheets of non standard, custom-cut eight-inch by thirteen-inch (8"×13") paper are inserted in the paper tray in preparation of the printing process. Referring to FIG. 3, the printer prints the first half of the book in the following sequence: 3, 23, 7, 27, 11, 31, 15, 35, 19.

Once the paper is printed on the first (front) side, the stack of printed paper is re-inserted in the printer paper tray (printed side down) in the same order in which it was printed. The printer prints the second half of the book in the following sequence: 20, 16, 36, 12, 32, 8, 28, 4, 24. As the pages are printed, they are stacked automatically in numerical order so as to eliminate collating. For example, the printed sheets are stacked beginning with text page three on the left-hand half and text page twenty-three on the right-hand half of the front side of the first sheet, and ending with text page twenty on the right-hand half and a blank sheet on the left-hand of the reverse side of the last sheet.

Referring to FIG. 4, after the pages are printed and stacked, the printed sheets are cut in half with a paper cutter so that each page measures 8"×6½". Cutting the sheets in half produces two stacks of 8"×6½ pages. Referring to FIG. 5, the computer operator places the first stack with the smaller numbers (starting with page 3) on top of the second stack with the larger numbers (starting with page 23) so that the front side of the pages are numbered in the following sequence: 3, 7, 11, 15, 19, 23, 27, 31, 35, and the reverse side is numbered in this sequence: 4, 8, 12, 16, 20, 24, 28, 32, 36.

Referring to FIGS. 3 and 4, two text pages 10 are provided on each side of sheet 16, i.e. two side-by-side text pages 10 on a front side 17 of sheet 16 and two side-by-side text pages 10 on a reverse side 18 of sheet 16. The text page 10 on the left-hand half 19 of the front side 17 and the text page 10 on the right-hand half 20 of the reverse side 18 of each sheet 16 are consecutively-numbered, and the text page 10 on the right-hand half 21 of the front side 17 and the text page 10 on the left-hand half 22 of the reverse side 18 of the same sheet 16 are also consecutively-numbered. In other words, a first text page is on the left-hand half 19 of the front side 17 of the sheet 16, a second text page, consecutively-numbered after the first text page, is on the right-hand half 20 of the reverse side 18 of the sheet 16, a third text page is on the right-hand half 21 of the front side 17 of the sheet 16, and a fourth text page, consecutively-numbered after the third text page, is on the left-hand half 22 of the reverse side 18 of the sheet 16.

A two page gap is provided before the first two consecutively-numbered text pages on the left-hand half of the front side and the right-hand half of the reverse side of a first eight-inch by thirteen-inch sheet and also between every two consecutively-numbered text pages on the left-hand half of the front side and the right-hand half of the reverse side of each of the following sheets. Similarly, a two page gap is provided between the two consecutively-numbered text pages on the right-hand half of the front side and the left-hand half of the reverse side of each of the sheets. Depending on the total number of pages in the book, the text pages on the right-hand half of the front side and the left-hand half of the reverse side may vary relative to the text pages on the left-hand half of the front side and the right-hand half of the reverse side of each sheet.

For example, utilizing the eight-inch by thirteen-inch sheets to make a thirty-six page book which comprises eighteen text pages and eighteen picture pages, the sheets are printed such that the first sheet has text page three on the left-hand half of the front side, text page four on the right-hand half of the reverse side, text page twenty-three on the right-hand half of the front side, and text page twenty-four on the left-hand half of the reverse side. The second sheet has text page seven on the left-hand half of the front side, text page eight on the right-hand half of the reverse side, text page twenty-seven on the right hand half of the front side, and text page twenty-eight on the left-hand half of the reverse side. The remaining three sheets are printed to have corresponding page gaps therebetween. The printed eight-inch by thirteen-inch sheets are stacked by the laser printer in a numerical order beginning with text page three on the left-hand half and text page twenty-three on the right-hand half of the front side of the first sheet, and ending with text page twenty on the right-hand half and a blank sheet on the left-hand half of the reverse side of the last sheet.

The stack of eight-inch by thirteen-inch sheets, printed with two side-by-side text pages on each side thereof, are cut in half along line 23 to form two stacks of six and one-half by eight-inch sheets having one text page on each side of the cut sheets. The left-hand stack of sheets is in a numerical order beginning with text page three on the front side of the first sheet and ending with text page twenty on the reverse side of the last sheet, and the right-hand stack of sheets is in a numerical order beginning with text page twenty-three on the front side of the first sheet and ending with text page thirty-six on the reverse side of the last sheet (after removing a blank sheet at the bottom of the right-hand stack). The left-hand stack of sheets is placed on top of the right-hand stack of sheets to thereby form a first set of sheets for assembling the book.

A second set of sheets, comprising art work or picture pages, is placed to the right of the first set of sheets comprising text pages. The second set of sheets comprises 8"×6½" paper having artwork or pictures preprinted on the front and reverse sides thereof, and collated in a proper numbered sequence for the specified book. The second set of sheets is collated in with the first set of sheets (i.e., laser printed pile of text pages) in an alternating manner beginning with page 1 to achieve the proper number sequence for the specified book. For a thirty-six page book, the stack of collated sheets comprises picture pages one and two, text pages three and four, picture pages five and six, text pages seven and eight, and so forth, ending with text pages thirty-five and thirty-six. A blank page follows text page thirty-six.

In order to bind the stack of collated sheets together into book form, self-adhesive sheets, having backing thereon, are placed on the top and bottom of the stack of collated sheets. The stack of sheets is then stapled together along one edge, and the backing is removed from the adhesive sheets. The stack of sheets is placed within a hard cover, and the adhesive sheets are pressed against the inner surfaces of the cover to thereby form an assembled book.

Although the invention has been described with reference to preferred embodiments, numerous modifications and rearrangements can be made with the result still coming within the scope of the invention.

What is claimed is:

1. A method of making a personalized, children's storybook having non-variable text and variable text merged together to create a complete, personalized story, comprising:

pre-entering non-variable text, to be completed by entry of personalized data, in a computer to form an incomplete storybook format;

obtaining personal data about a recipient of said storybook to develop the complete text for said storybook format;

entering said variable text in said computer;

storing said variable text in a memory of said computer;

merging said variable text with said non-variable text to insert said variable text into said non-variable text forming merged text thereby completing said storybook format and forming a complete personalized story;

inserting a sufficient number of single sheets containing no text in a computer printer to enable printing of said merged text of said complete personalized story;

sending said complete, personalized story to said printer;

printing said story on one side of said sheets to thereby form text pages of said storybook and printing on the other side of said sheets to complete the printing of said story;

manually cutting said printed sheets in half;

stacking said cut sheets so that smaller numbered text pages are placed on top of larger numbered text pages;

hand collating said printed text pages with preprinted picture pages in an alternating manner to form a properly numbered sequence for said book;

placing self-adhesive sheets on the front and back of said collated pages;

manually stapling together said sheets and pages;

peeling backing sheets off said self-adhesive sheets; and binding said book into a hard cover.

2. A method according to claim 1 wherein said printing step includes first printing odd-numbered pages of said book.

3. A method according to claim 2 wherein said odd-numbered pages are printed in the following page sequence: 3, 23, 7, 27, 11, 31, 15, 35, 19.

4. A method according to claim 2 further comprising: printing even-numbered pages of said book.

5. A method according to claim 4 wherein said even-numbered pages are printed in the following page sequence: 20, 16, 36, 12, 32, 8, 28, 4, 24.

6. A method according to claim 1 wherein said blank sheets are non-standard, custom-cut eight-inch by thirteen-inch sheets.

7. A method according to claim 1 wherein a single laser printer is used to perform said printing step.

8. The method according to claim 1, wherein said storybook is printed one at a time.

* * * * *